US011235379B2

(12) United States Patent
Fargeas et al.

(10) Patent No.: US 11,235,379 B2
(45) Date of Patent: Feb. 1, 2022

(54) FOUNDRY PROCESS WITH HOT MOLD CASTING

(71) Applicant: SAFRAN AIRCRAFT ENGINES, Paris (FR)

(72) Inventors: Serge Alain Fargeas, Moissy-Cramayel (FR); Serge Tenne, Moissy-Cramayel (FR); Dominique Coyez, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 0 days.

(21) Appl. No.: 16/627,060

(22) PCT Filed: Jun. 29, 2018

(86) PCT No.: PCT/FR2018/051617
§ 371 (c)(1),
(2) Date: Dec. 27, 2019

(87) PCT Pub. No.: WO2019/002797
PCT Pub. Date: Jan. 3, 2019

(65) Prior Publication Data

US 2020/0180016 A1 Jun. 11, 2020

(30) Foreign Application Priority Data

Jun. 29, 2017 (FR) ..... 1755990

(51) Int. Cl.
*B22C 9/04* (2006.01)
*B22D 27/04* (2006.01)
(Continued)

(52) U.S. Cl.
CPC ..... *B22C 9/12* (2013.01); *B22C 9/04* (2013.01); *B22C 13/08* (2013.01); *B22D 21/025* (2013.01); *B22D 27/04* (2013.01)

(58) Field of Classification Search
CPC ..... B22D 27/00; B22D 27/04; B22C 9/04; B22C 7/02
See application file for complete search history.

(56) References Cited

U.S. PATENT DOCUMENTS 3,283,377 A * 11/1966 Chandley ..... B22C 9/04 164/65
3,861,449 A * 1/1975 Barbero ..... B22D 27/04 164/65
(Continued)

FOREIGN PATENT DOCUMENTS

CN 101240384 A 8/2008
CN 101972842 A 2/2011
(Continued)

OTHER PUBLICATIONS

International Search Report dated Sep. 12, 2018, in corresponding PCT Application No. PCT/FR2018/051617 (4 pages).
(Continued)

*Primary Examiner* — Kevin E Yoon
(74) *Attorney, Agent, or Firm* — Bookoff McAndrews, PLLC

(57) ABSTRACT

The invention relates to the foundry field, and in particular to a foundry process comprising the preheating of a mold (1) up to a first temperature, the casting of a metal in the liquid state, at a second temperature above the first temperature, in the mold kept in a main furnace (100) at the first temperature since the preheating, the difference between the first temperature and second temperature being no more than 80° C., the cooling and solidification of the metal in the mold (1) kept in the main furnace (100) at a pressure of less than 0.1 Pa at least since the casting, the removal of the mold (1) from the main furnace (100), and the demolding of the solidified metal.

8 Claims, 9 Drawing Sheets

(51) Int. Cl.

| | |
|---|---|
| ***B22C 9/12*** | (2006.01) |
| ***B22C 13/08*** | (2006.01) |
| ***B22D 21/02*** | (2006.01) |

(56) References Cited

U.S. PATENT DOCUMENTS

| | | | | |
|---|---|---|---|---|
| 3,981,344 | A | 9/1976 | Hayes et al. | |
| 4,186,222 | A * | 1/1980 | Sellars | B22C 9/04 106/38.27 |
| 4,809,764 | A * | 3/1989 | Prasad | B22D 27/045 164/122.1 |
| 4,832,112 | A * | 5/1989 | Brinegar | B22D 27/00 164/122 |
| 5,072,771 | A | 12/1991 | Prasad | |
| 2007/0034350 | A1* | 2/2007 | Renkel | F01D 25/005 164/519 |
| 2013/0156637 | A1* | 6/2013 | Park | B22D 27/08 420/591 |
| 2015/0352630 | A1* | 12/2015 | Bewlay | B22C 9/02 164/349 |

FOREIGN PATENT DOCUMENTS

| | | | | |
|---|---|---|---|---|
| EP | 2727669 | A2 | 5/2014 | |
| FR | 2870147 | A1 | 11/2005 | |
| FR | 2870148 | A1 | 11/2005 | |
| GB | 2102317 | A | 2/1983 | |
| JP | H08174145 | A | 7/1996 | |
| JP | 2013 252566 | A | 12/2013 | |
| WO | WO 2016/125575 | A1 | 8/2016 | |
| WO | WO-2017068023 | A1 * | 4/2017 | F01D 5/187 |

OTHER PUBLICATIONS

Office Action dated Dec. 18, 2020, in Chinese Patent Application No. 201880043791.2 and translation (25 pages).

Ruiling Liu, etc., Shi Jia Zhuang, "Practical founder quick reference manual," (First Edition), Hebei Science and Art Press, pp. 470-473.

Huaqing Liao, etc., Bei Jing, "Marginless melted module precise casting," (First Edition), National Defense Industry Press, pp. 169-170.

"Metal Technology Experiment Guide (1st Edition)", Pan Chuchen, Beijing: Higher Education Press, Aug. 1984, p. 25.

Office Action dated Jun. 17, 2021, in Chinese Patent Application No. 201880043791.2 and translation (25 pages).

* cited by examiner

FOUNDRY PROCESS WITH HOT MOLD CASTING

CROSS-REFERENCE TO RELATED APPLICATION(S)

This application is the U.S. national phase entry under 35 U.S.C. § 371 of International Application No. PCT/FR2018/051617, filed on Jun. 29, 2018, which claims priority to French Patent Application No. 1755990, filed on Jun. 29, 2017.

BACKGROUND OF THE INVENTION

The present invention relates the field of metal casting. In the present context, "metal" refers to both pure metals and metal alloys.

With known foundry processes, involving at least one step of casting a metal in the liquid state in a mold, followed by cooling and solidifying the metal in the mold before removing the solidified metal from the mold, defects may occur, particularly when producing components with particularly thin parts, such as the trailing edges of gas turbine blades. Indeed, the temperature difference between the metal and the mold at the time of casting can cause premature cooling and solidification of a part of the metal in the narrowest passages of the mold cavity, which can cause cracks, voids or other defects in the molded part.

In order to reduce the thermal shock during casting, it was proposed to carry out a first step of preheating the mold in a dedicated furnace. However, the use of such a dedicated preheating furnace requires the removal of the mold from the preheating furnace and its transport to the casting site. During this extraction and transport, the mold starts to cool, which again increases the possibility of defects. In addition, these additional operations with a hot mold complicate the foundry process and require additional time and space, while also increasing the risk of workplace accidents.

SUBJECT MATTER AND SUMMARY OF THE INVENTION

The present disclosure is intended to address these disadvantages by proposing a foundry process that will more effectively avoid defects, while reducing mold movement and simplifying the process.

In at least one embodiment, this goal is achieved by the fact that, after preheating the mold to a first temperature, the casting of a metal in the liquid state, at a second temperature higher than the first temperature and, for example, at least equal to 1250° C., is carried out in the mold maintained in a main furnace at the first temperature since the preheating, the difference between the first and second temperatures being not more than 170° C., and preferably not more than 100° C., or even 80° C., and that the cooling and solidification of the metal in the mold is carried out while the mold is maintained in the main furnace at a pressure below 0.1 Pa at least since casting, before the mold is extracted from the main furnace.

Thanks to these provisions, the thermal shock of the casting is reduced and the cooling rate of the metal is then reduced, thus limiting the risk of defects due to premature solidification of the metal in the narrowest passages of the mold cavity, while also limiting the movements of the mold and the number of process operations.

In order to further reduce the risk of defects in the part obtained by this foundry process, the step of cooling and solidifying the metal in the mold held in the main furnace at a pressure below 0.1 Pa can be carried out with a furnace cooling rate lower than or equal to 7° C./min. Such controlled cooling prevents cracks and other similar defects, particularly caused by the different rates of thermal contraction of the metal and mold material.

In order to limit the occupancy time of the main furnace by the mold, and thus increase the production rate, the mold preheating step can be performed at least in part in a preheating furnace different from the main furnace.

In particular, the metal can solidify into equiaxed grains. This process is therefore not limited to the foundry with directed crystal growth, but is applicable to traditional equiaxed polycrystalline metal alloys which form, in the solid state, a plurality of grains of substantially identical size, typically of the order of 1 mm, but of more or less random orientation.

The mold can in particular be a shell mold formed around a mold cavity, for example by the so-called lost wax or lost model process. In this case, in order to prevent even more effectively the formation of defects in the part resulting from this process, at least a first part of the mold around the mold cavity may have a wall thickness less than a second part of the mold around the mold cavity. In particular, when the mold is formed by a plurality of superposed layers, as shell molds formed by dipping a pattern several times in a slip bath, the second part of the mold may have a greater number of layers than the first part of the mold. By modulating the wall thickness of the mold in this way, in particular according to the thickness of the cavity at the same location, it is possible to avoid that the different rates of thermal contraction of the metal and the mold material cause excessive mechanical stresses on the metal during cooling and solidification, which could lead to cracks and other similar defects. A local reduction in the wall thickness of the mold, especially around the most vulnerable parts of the metal in the mold cavity, reduces the stresses that the mold can transmit to the underlying metal at these locations during cooling.

In order to avoid premature solidification of the metal during casting, it may last less than 2 seconds or even 1 second or less.

This foundry process can in particular be used to form, together with the solidified metal, components with particularly thin parts such as, for example, at least one gas turbine blade.

BRIEF DESCRIPTION OF THE DRAWINGS

The invention will be well understood and its advantages clearer by reading the detailed description below of an embodiment represented by way of non-limiting example. The description refers to the appended drawings on which.

DETAILED DESCRIPTION OF THE INVENTION

Figure 1:
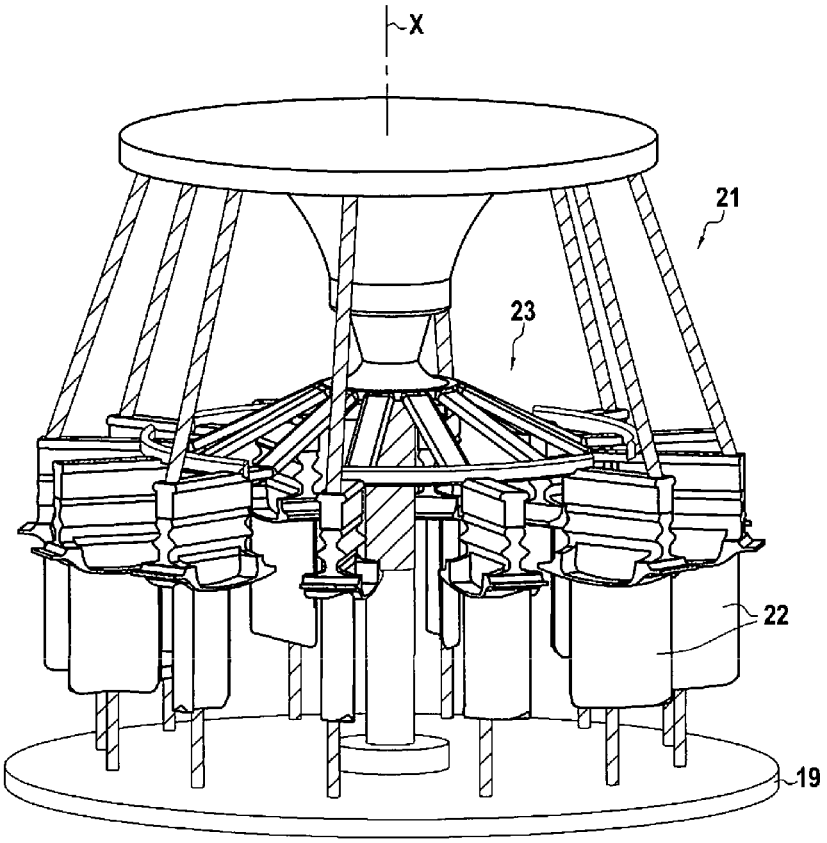
FIG. 1 illustrates a cluster of wax models created in a first step of a foundry process according to a first embodiment of the invention.

A first step of a foundry process according to a first embodiment of the invention is the creation of a non-permanent cluster 21 comprising a plurality of models 22 connected by a shaft 23 supported by a tray 19, as shown in FIG. 1. The parts of the shaft 23 intended to form hollow volumes in the mold 1 are formed from a low melting temperature material, such as a wax or modelling resin, while other parts of the shaft 23, forming stiffeners, can be made from refractory material (hatched in FIG. 1). The models 22, which will form mold cavities in the mold, are also formed from a low melting temperature material. When large numbers of components are to be produced, it is possible to produce these elements by injecting wax or modelling resin into a permanent mold. In the embodiment shown, for the production of gas turbine blades, the models 22 represent such blades, with the blade head facing down.

To produce a mold, more specifically a shell mold, from this non-permanent cluster 21, the cluster 21 is dipped in a slip and then sprinkled with refractory sand, i.e. grains of refractory material. The materials used for slip and refractory sand, as well as the grain size of refractory sand, can be, for example, those disclosed in French patent application publications FR 2 870 147 A1 and FR 2 870 148 A1. For example, the slip may contain particles of ceramic materials, particularly in the form of flour, with an inorganic colloidal binder and possibly additives depending on the desired rheology for slip, while refractory sand may also be ceramic. Ceramic materials that can be considered for slip and/or refractory sand include alumina, mullite and zircon. The mineral colloidal binder can be for example a water-based mineral colloidal solution, such as colloidal silica. Admixtures may include a wetting agent, a fluidifier and/or a texturizer. These tempering and sprinkling steps can be repeated several times, possibly with different slip and sand, until a sand shell impregnated with slip of a desired thickness is formed around the cluster 21.

Figure 2A:
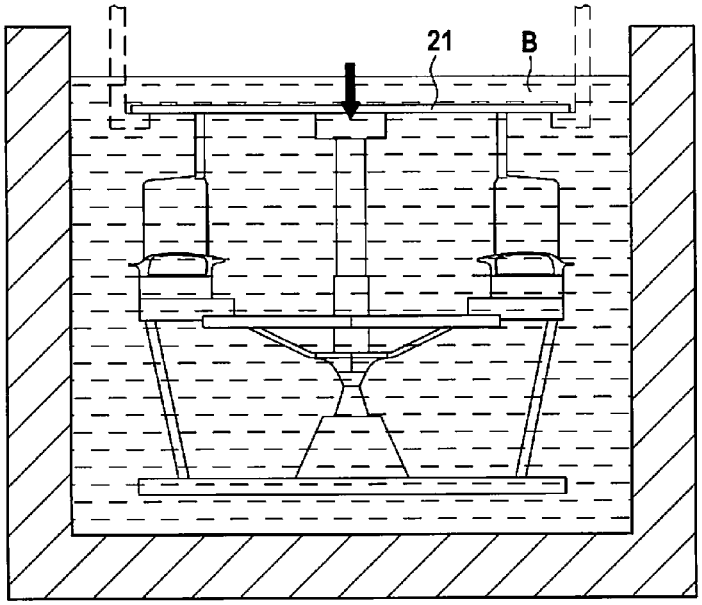
FIGS. 2A and 2B illustrate two subsequent steps of the process, wherein the cluster is immersed entirely in a slip bath and then sprinkled to form a layer of a shell mold.
Figure 2B:
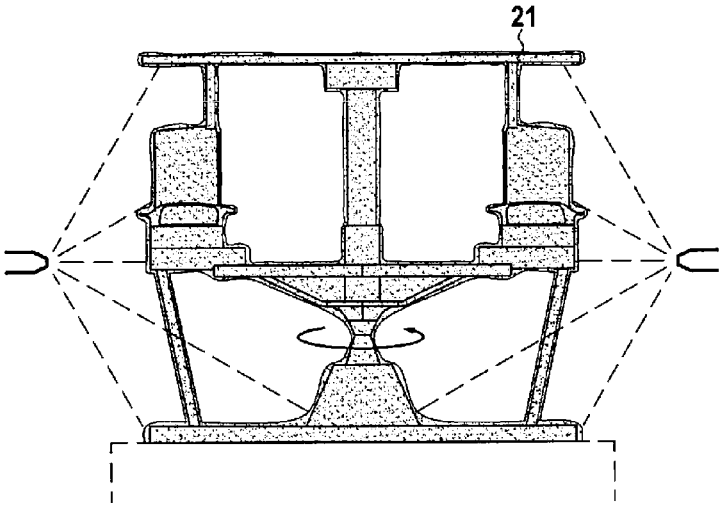
Figure 3A:
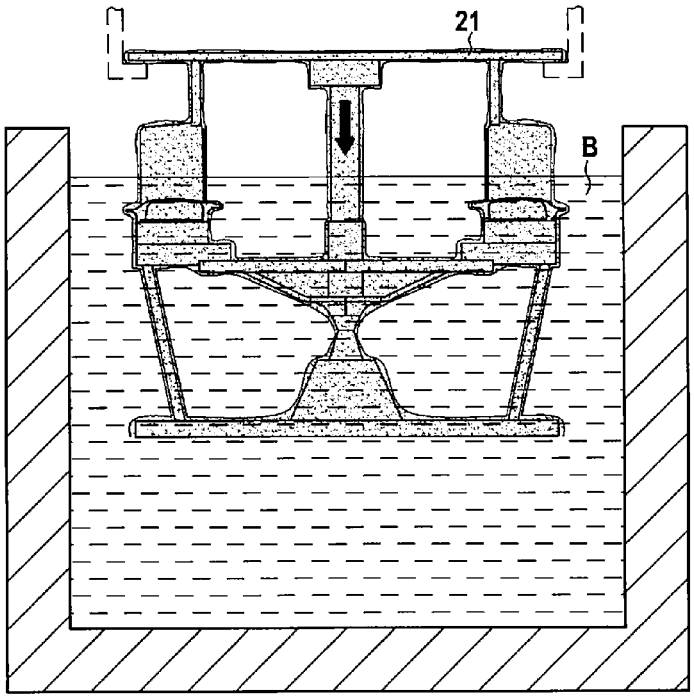
FIGS. 3A and 3B illustrate two subsequent steps of the process, wherein the cluster is partially immersed in the slip bath and then sprinkled to form an additional layer of the shell mold.
Figure 3B:
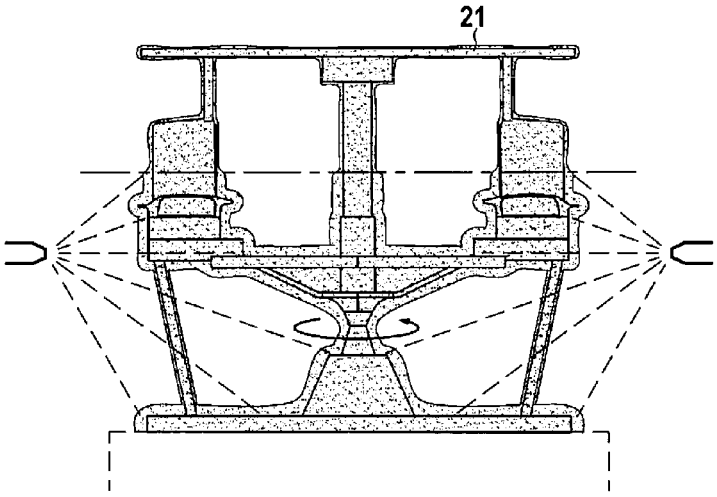

In the process according to this first embodiment, the aim is to produce a mold wherein at least a first part of the mold has a wall thickness around the mold cavities that is less than that of a second part of the mold around the same mold cavities. More specifically, in this first embodiment, as shown, the aim is to obtain thinner walls at the blade heads than at the blade feet. To obtain this difference in thickness, after initial quenching, shown in FIG. 2A, wherein the cluster 21 is soaked entirely in the slip B, as shown in FIG. 2A, before being sprinkled with sand as shown in FIG. 2B, partial soaking is carried out, shown in FIG. 3A, wherein the cluster 22 is dipped, inverted, only up to half blade height before being sprinkled as shown in FIG. 3B. The upper part of the shell thus formed will therefore have a greater number of layers than its lower part. Alternatively, however, it is also possible to start with partial soaks, and end with integral soaks: only the order of layers will change, but the distribution of wall thicknesses will remain the same. It is also possible to soak at more than two different levels.

Figure 4:
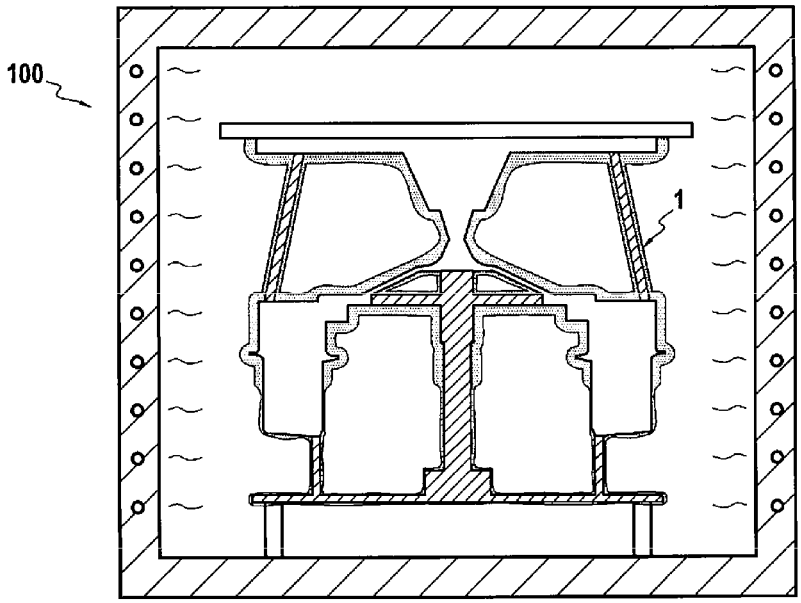
FIG. 4 illustrates a next step in firing the shell mold.

The cluster 21 coated with this shell can then be heated, for example in an autoclave to a temperature between 160 and 180° C. and a pressure of 1 MPa, to melt and remove the low melting temperature material of the cluster 21 from the inside of the shell. Then, in a firing step at higher temperature, for example between 900 and 1200° C., the slip solidifies to consolidate the refractory sand to form the refractory walls of the mold 1, as shown in FIG. 4.

Figure 5A:
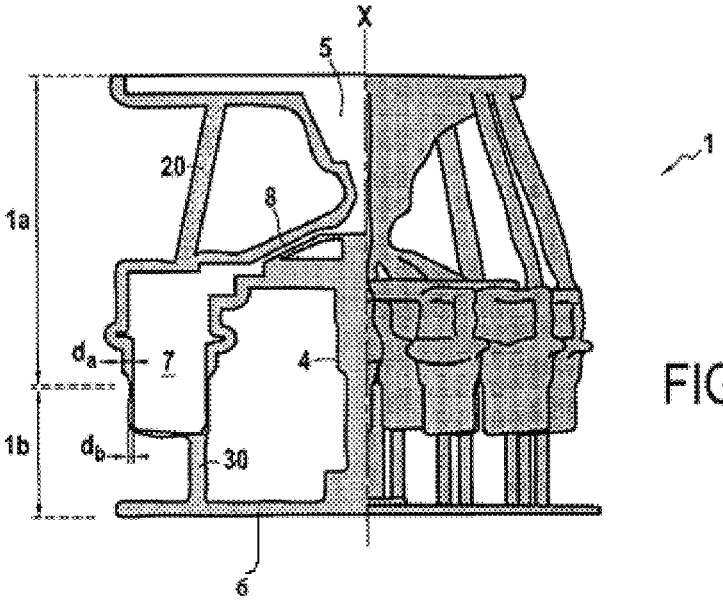
FIG. 5A shows the shell mold after firing.

The mold 1 thus formed, also shown in FIG. 5A, is a shell mold with a central shaft 4 extending towards the main axis X between a casting cup 5 and a tray-shaped base 6. The mold 1 also includes a plurality of casting cavities 7 arranged in clusters around the central shaft 4. Each mold cavity 7 is connected to the casting cup 5 by a feed channel 8 through which the molten metal is introduced during casting. The base 6 of the mold 1 is in the shape of a tray. In addition, inclined column-shaped stiffeners 20 connect the top of each mold cavity 7 to the top of casting well 5, and other vertical column-shaped stiffeners 30 connect the bottom of each mold cavity 7 to the base 6. Due to the greater number of layers of fired slip and refractory sand in the upper part 1*a* of the mold 1 with respect to its lower part 1*b*, the thickness $d_a$ of the walls of the upper part 1*a* of the mold 1 around each mold cavity 7 is greater than the thickness $d_b$ of the walls of the lower part 1*b* of the mold 1 around the same mold cavities 7. Thus, the thickness $d_a$ can be, for example, between 2.5 and 9 mm, while the thickness $d_b$ can be, for example, between 1.5 and 6 mm.

Figure 5B:
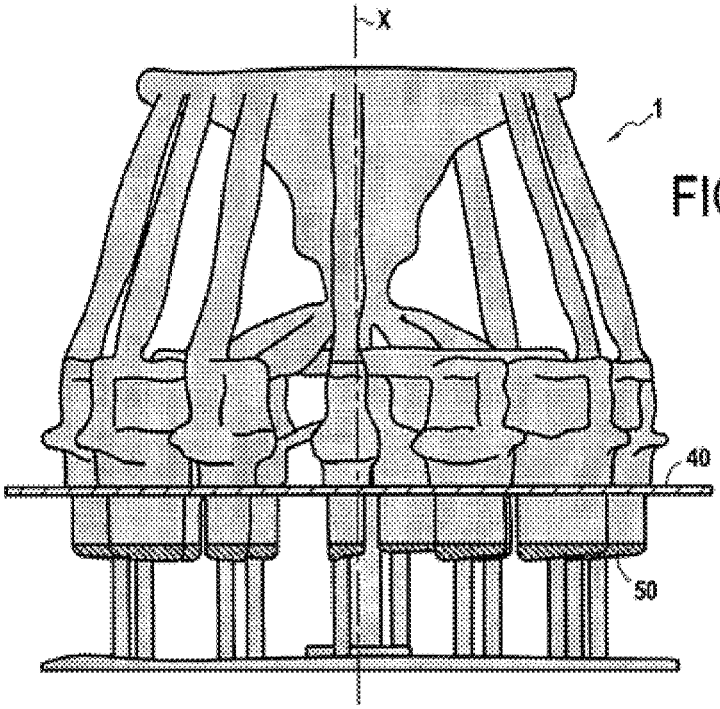
FIG. 5B shows the shell mold in FIG. 5A after the addition of a heat shield

Furthermore, as shown in FIG. 5B, to this mold 1 can be added at least one heat shield 40, for example of graphite, perpendicular to the main axis X, as well as refractory insulators 50, locally situated in preferential areas of the mold 1.

Figure 6A:
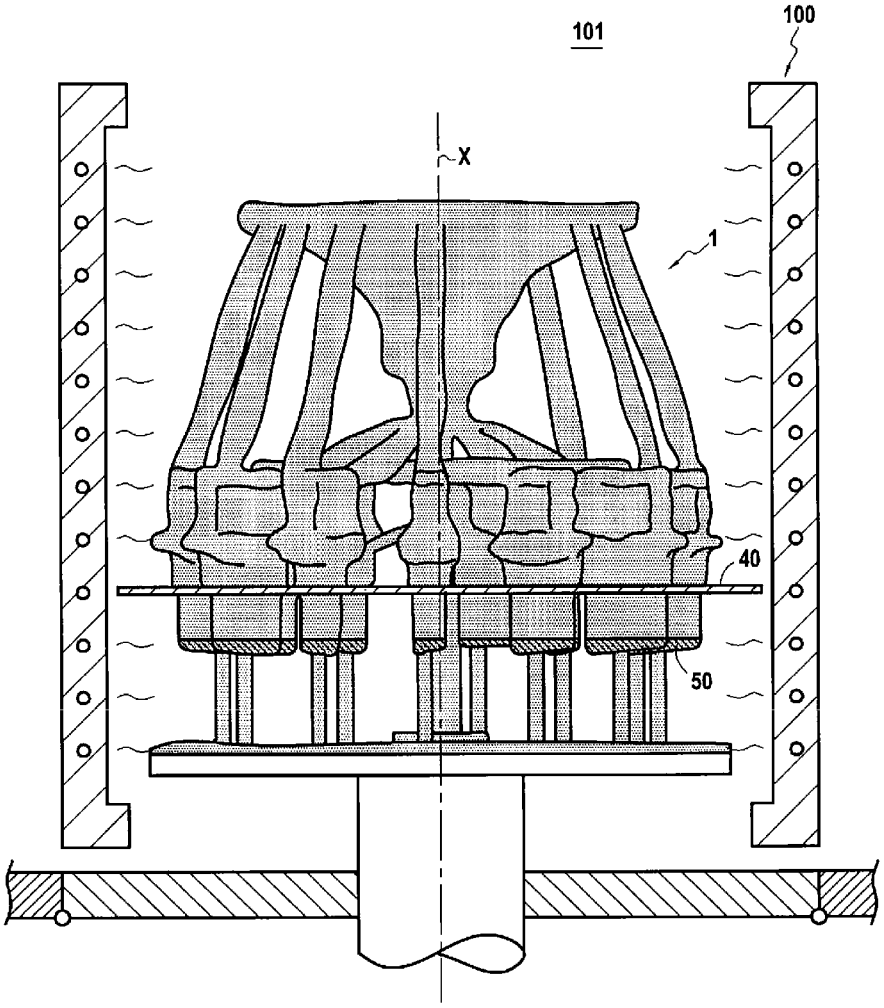
FIGS. 6A, 6B and 6C illustrate consecutive steps of shell mold preheating, casting, and controlled cooling, performed in the same main furnace.
Figure 6B:
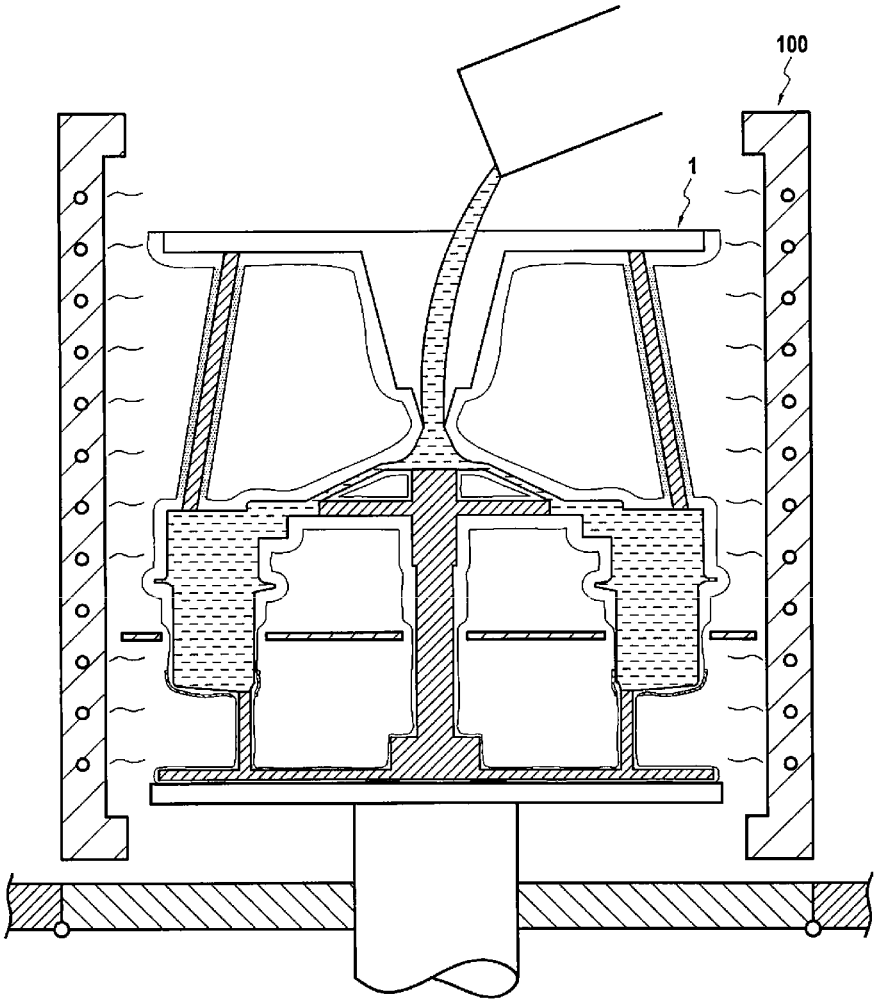

In this first embodiment, before casting the metal in the liquid state in this mold 1, a preheating step is carried out for this mold 1, shown in FIG. 6A. In this step, after introducing the mold 1 into a main furnace 100, located in a vacuum chamber 101 wherein a pressure $p_v$ is maintained equal to or lower than, for example, 0.1 Pa, the mold 1 is heated in the main furnace 100, which reaches a first temperature $T_1$. Then, without removing the mold 1 from the main furnace 100, while maintaining the main furnace 100 at the first temperature $T_1$ and pressure $p_v$, the metal is poured in the liquid state into the mold 1, as shown in FIG. 6B, so as to fill the hollow volumes of the mold 1, and in particular its mold cavities 7. The metal is poured into the mold at a second temperature $T_2$, higher than the first temperature $T_1$. However, the temperature difference $\Delta T$ between the second temperature $T_2$ and the first temperature $T_1$ is limited, for example not more than 170° C., or even 100° C., or even 80° C. Thus, if the metal is, for example, a nickel-based equiax alloy of the René 77 type, with a solidus at about 1240° C. and a liquidus at about 1340° C., the second temperature $T_2$ can be, for example, 1450° C., and the first temperature $T_1$ can then be 1350° C., with a difference $\Delta T$ not exceeding 170° C. This avoids excessive thermal shock to the molten metal poured into the mold 1, reducing the risk of premature and untimely solidification of the metal in the narrowest passages of the mold 1, which could cause local blockages and defects in the components thus produced. The casting of the liquid metal is carried out quickly and thus completed in a time $t_v$, which can for example be about 2 seconds or even a single second.

Figure 6C:
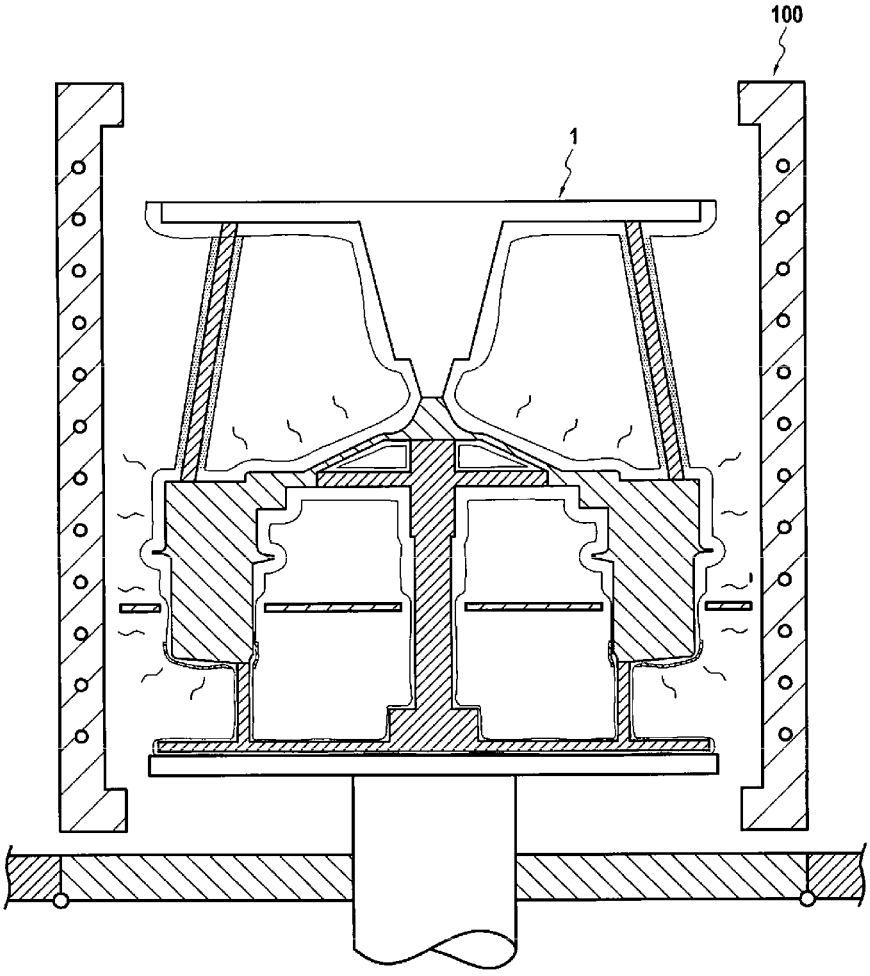

In the next step, shown in FIG. 6C, the mold 1 is still held in the main furnace 100 during a first cooling and solidification step of the metal in the mold 1, wherein the pressure $p_v$ is maintained and the cooling rate dT/dt of the furnace is controlled and limited, for example, to about 7° C./min maximum. The pressure $p_v$, close to vacuum, prevailing inside the main furnace 100 makes it possible to restrict or even eliminate any convective cooling of the mold 1, in such a way that the cooling of the mold 1 during this stage is essentially radiative, and therefore easier to regulate inside the main furnace 100. In addition, the heat shield 40 allows the interior of the main furnace 100 to be divided into two thermally independent zones, to ensure more homogeneous cooling of the mold 1 and the metal therein. The upper limit of the cooling rate also limits the forces exerted on the metal by the difference in thermal contraction between the mold 1 and the cooling metal. That, around the mold cavities 7, the thickness $d_b$ of the walls of the lower part 1*b* of the mold 1 is less than the thickness $d_a$ of the walls of the upper part 1*a* of the mold 1 also makes it possible to limit these forces on the metal in the narrowest parts of the mold cavities 7, which are those corresponding to the blade heads, in particular near the trailing edge. The narrower walls of the mold 1 at these locations will yield under stress, rather than the metal. Thus, possible cracks will form in the mold 1, rather than in the metal.

In this first embodiment, as the René 77 alloy is an equiaxed polycrystalline alloy, the metal will form, upon solidification, a plurality of grains of substantially identical size, typically of the order of 1 mm, but of more or less random orientation.

Figure 7:
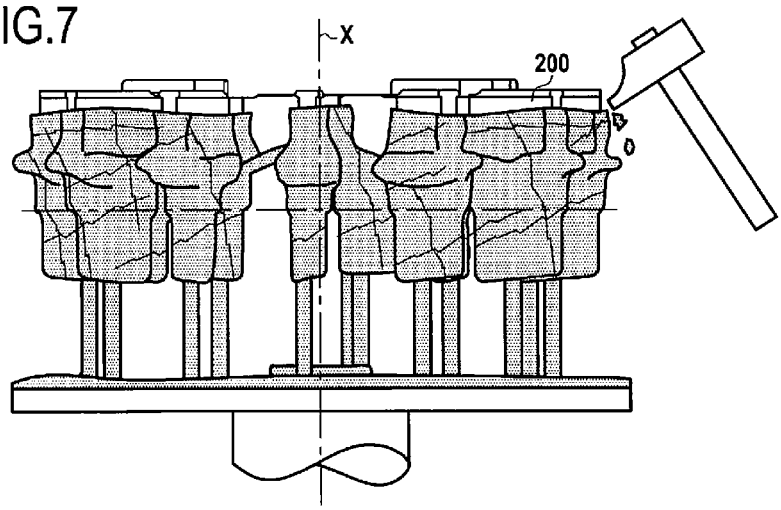
FIG. 7 illustrates a final demolding step.

After the metal has solidified in the mold 1, when the mold 1 has cooled sufficiently to a third temperature $T_3$ of, for example, 800° C. to 900° C., it can be removed from the main furnace 100 and the vacuum chamber 101 in an extraction step and then continue to cool naturally to normal ambient pressure and temperature after being placed under an insulating bell surrounded by refractory fabric, to the shell stripping step, shown in FIG. 7, wherein the mold is destroyed to remove the solidified metal, comprising the gas turbine blades 200 thus formed, on which subsequent cutting and finishing steps can then be carried out.

Thanks to the reduction of thermal stresses on the metal in this foundry process, it is possible to produce particularly thin components, such as rotating or guiding gas turbine blades. Thus, in the table below, blade dimensions that can be achieved with a conventional foundry process are compared with those achieved with the process of this first embodiment on the basis of the same material:

| Dimension | Process with preheating to $T_1$ and cooling to $p_v$ | Comparative example |
|---|---|---|
| Height from blade foot to blade head | 160-190 mm | 160 mm |
| Chord length | 25-40 mm | 25-30 mm |
| Thickness at 1 mm from the trailing edge | 0.25-0.45 mm | 0.5-0.6 mm |
| Maximum blade profile thickness | 1-2 mm | 1.8-3 mm |

Although, in the first embodiment described above, the step of preheating the mold 1 is carried out entirely in the main furnace 100, it is also possible to carry out this preheating, in whole or part, in a different preheating furnace, before introducing the mold into the main furnace, in order to reduce the time that the mold will occupy the main furnace, and thus increase the production rate.

Figure 8:
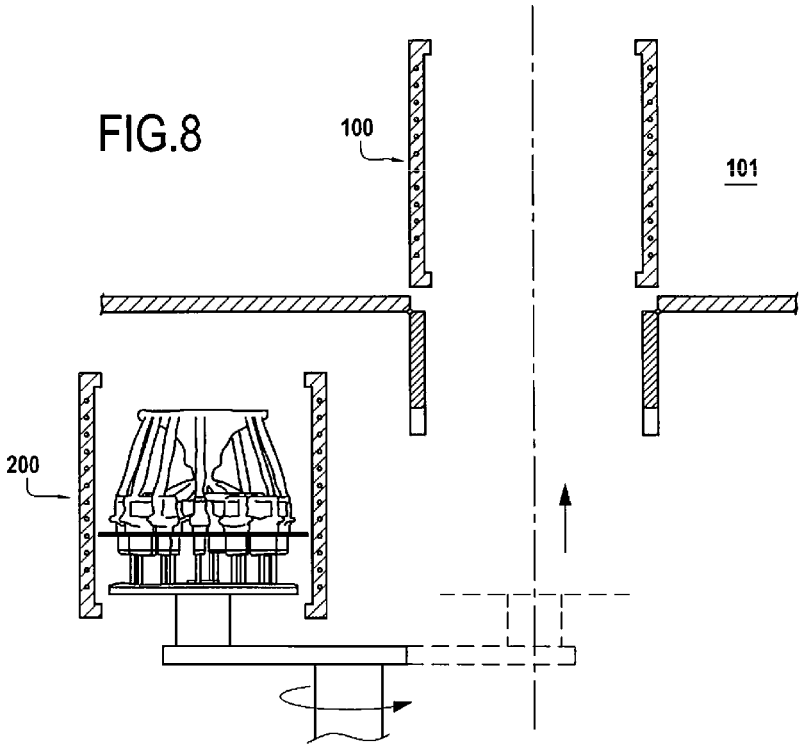
FIG. 8 illustrates a preheating step according to an alternative embodiment, wherein the mold is initially preheated in a preheating furnace before being introduced into a main furnace, different from the preheating furnace, wherein the casting and controlled cooling steps are performed.

Thus, as shown in FIG. 8, in a foundry process according to a second embodiment, the mold 1, which may be equivalent to that of FIG. 5, and produced by steps similar to those in FIGS. 1 to 4, can be introduced into a preheating furnace 200, which can be at normal atmospheric pressure outside the vacuum chamber 101, to be initially preheated to a preheating temperature $T_0$, lower or equal to the first temperature $T_1$, before being transferred to the main furnace 100, where it can be further heated to reach and/or maintain the mold 1 at the first temperature $T_1$, until the metal casting step, which can also be similar to that of the first embodiment, as well as subsequent steps.

Although the present invention has been described by reference to a specific exemplary embodiment, it is obvious that different modifications and changes can be made without going beyond the general scope of the invention as defined by the claims. Therefore, the description and drawings should be considered in an illustrative rather than restrictive sense.

The invention claimed is:

1. A foundry process comprising the following steps:

preheating of a mold in a main furnace to a first temperature, wherein the mold is a shell mold which extends downwards from a casting cup to a base, and a lower part of the mold around a mold cavity has a wall thickness less than a wall thickness of an upper part of the mold around the mold cavity;

casting of a metal in the liquid state, at a second temperature higher than the first temperature, in the mold held in the main furnace at the first temperature since preheating, the difference between the first and second temperatures being not more than 170° C.;

cooling and solidification of the metal in the mold held in the main furnace at a pressure below 0.1 Pa at least since casting, wherein the metal solidifies into equiaxed grains;

extraction of the mold from the main furnace; and demolding of the solidified metal.

2. The foundry process as claimed in claim 1, wherein the difference between the first temperature and the second temperature is not more than 100° C.

3. The foundry process as claimed in claim 2, wherein the difference between the first temperature and the second temperature is not more than 80° C.

4. The foundry process as claimed in claim 1, wherein the step of cooling and solidifying the metal in the mold held in the main furnace at a pressure below 0.1 Pa is carried out with a cooling rate of the furnace lower than or equal to 7° C./min.

5. The foundry process as claimed in claim 1, wherein the mold is formed by a plurality of superposed layers, and the upper part of the mold has a greater number of layers than the lower part of the mold.

6. The foundry process as claimed in claim 1, wherein the casting step has a duration of less than 2 seconds.

7. The foundry process as claimed in claim 1, wherein the second temperature is at least 1450° C. and less than 1480° C.

8. The foundry process as claimed in claim 1, wherein the solidified metal forms at least one gas turbine blade.

* * * * *